US008225430B2

(12) United States Patent
Chiang

(10) Patent No.: US 8,225,430 B2
(45) Date of Patent: Jul. 24, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 1165 days.

(21) Appl. No.: 12/076,133

(22) Filed: Mar. 14, 2008

(65) Prior Publication Data

US 2009/0205114 A1 Aug. 20, 2009

(30) Foreign Application Priority Data

Feb. 14, 2008 (TW) ..... 97202736 U

(51) Int. Cl.
*A61F 9/02* (2006.01)

(52) U.S. Cl. ..... 2/448; 2/426; 2/439; 2/440; 2/442; 2/445; 2/446; 2/452; 24/170; 24/173; 24/178; 24/191; 24/265 BC

(58) Field of Classification Search ..... 2/426, 439, 2/440, 442, 445, 446, 448, 452; 24/170, 24/173, 178, 191, 265 BC; 351/43, 156
See application file for complete search history.

(56) References Cited

U.S. PATENT DOCUMENTS

| | | | | |
|---|---|---|---|---|
| 7,134,149 | B2 * | 11/2006 | Sato | 2/431 |
| 7,185,373 | B2 * | 3/2007 | Chiang | 2/445 |
| 7,251,842 | B1 * | 8/2007 | Chiang | 2/445 |
| 7,631,400 | B2 * | 12/2009 | Chiang | 24/170 |
| 7,665,190 | B2 * | 2/2010 | Weng | 24/170 |
| 7,836,561 | B2 * | 11/2010 | Vaccaro et al. | 24/68 E |
| 2005/0155139 | A1 * | 7/2005 | Chiang | 2/428 |
| 2008/0189837 | A1 * | 8/2008 | Chiang | 2/431 |
| 2009/0100645 | A1 * | 4/2009 | Weng | 24/170 |

* cited by examiner

*Primary Examiner* — Khoa Huynh
*Assistant Examiner* — Sally Cline
(74) *Attorney, Agent, or Firm* — Cheng-Ju Chiang

(57) ABSTRACT

Swimming goggles have a frame unit, lenses and buckles assembled on the frame unit, and at least a head strap with a plurality of stop grooves. Each buckle comprises an abutting arm having a stop end, an operating lever being movable transversely and bringing the abutting arm to move, and an offset portion between the abutting arm and the operating lever. When the operating lever moves transversely, the offset portion makes the stop end of the abutting arm move upward or downward to abut or release the stop grooves of the head strap. The swimming goggles adjust length of the head strap easily.

12 Claims, 4 Drawing Sheets

SWIMMING GOGGLES

BACKGROUND OF THE INVENTION

1. Field of the Invention

The present invention relates to swimming goggles, and particularly to swimming goggles with an adjustable head strap.

2. Related Art

Swimming goggles typically adjust length of a head strap thereof with buckles. Such a buckle generally has a profile of two neighboring square rings, and defines two slots. Two free ends of the head strap respectively extend through the slots and overlap with each other. During adjustment of the head strap, friction between the overlapped portion of the head strap will block movement of head strap.

Furthermore, swimming goggles with a left frame, a right frame and a connecting portion integrated together, demand material which enables lenses retained in the left frame and the right frame. The material should not be so soft that can not fix the lenses and resist water pressure. The material is therefore limited to given rigidness, and a pad formed on the left frame and the right frame can not be soft sufficient to touch a user's face comfortably when wearing. Additionally, because the integrated swimming goggles opt for material with given rigidness, the connecting portion between the left frame and the right frame is too stiffened to suit for users with different face profiles, and the left frame and the right frame can not fit close to the user's face, thus taking risk of water leakage.

SUMMARY OF THE INVENTION

In view of the foregoing, an object of the present invention is direct to provide swimming goggles which transversely adjust a head strap easily and which are worn comfortably.

The swimming goggles comprise a frame unit, lenses and buckles assembled on the frame unit, and a strap element with at least a head strap. The head strap defines a plurality of stop grooves. The buckles are capable of abutting against or releasing the stop grooves of the head strap. Each buckle comprises an abutting arm having a stop end, an operating lever being movable transversely and driving the abutting arm to move, and an offset portion between the abutting arm and the operating lever. When the operating lever moves transversely, the offset portion makes the stop end of the abutting arm move upward or downward to abut or release the stop grooves of the head strap.

The offset portion comprises a recessed portion defined about a center of the operating lever. The recessed portion forms a first inclined surface. The stop end forms a stop block thereon, the stop block forming a second inclined surface for corresponding to the first inclined surface. When the operating lever moves transversely, the second inclined surface of the abutting arm moves along the first inclined surface to bring the stop end to move upwardly, releasing the stop grooves of the head strap.

DESCRIPTION OF THE PREFERRED EMBODIMENTS

Figure 2:
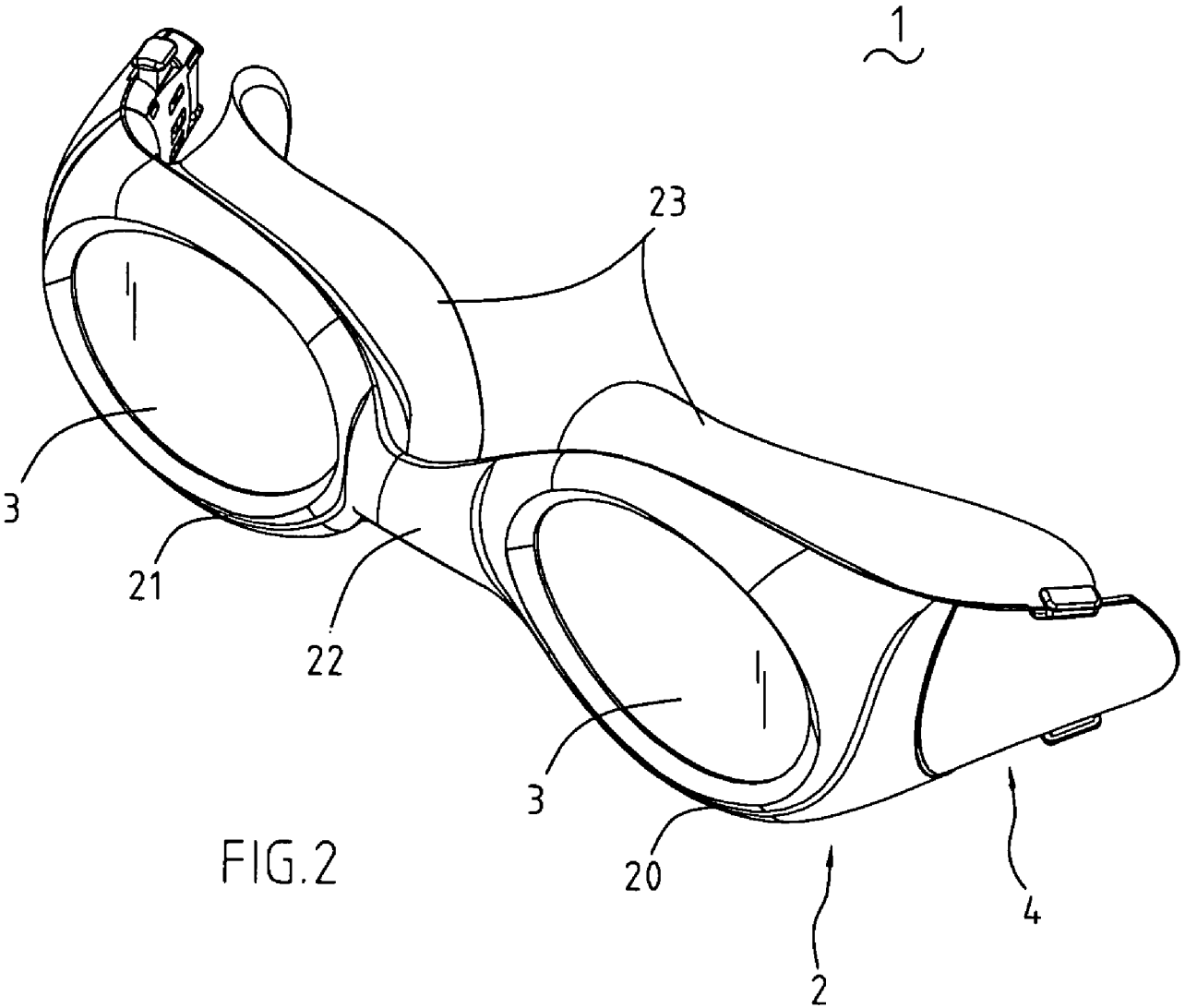
FIG. 2 is an assembled view of the swimming goggles of FIG. 1.

With reference to FIG. 2, swimming goggles 1 of the present invention comprise a frame unit 2, lenses 3 mounted on the frame unit 2, buckles 4 assembled on the frame unit 2, and a strap element 5. See FIG. 6, the strap element 5 has a head strap 50 defining stop grooves 51 therein. The buckles 4 are made of hard material, for example PP material, and are able to be assembled with the lenses 3 and the strap element 5. The frame unit 2 is unitarily made of soft material, for example thermal plastic rubber (TPR), Silica gel or the like, and includes a left frame 20, a right frame 21, a connecting portion 22 connecting the left frame 20 and the right frame 21, and a pad 23. The frame unit 2 shrouds edges of the lenses 3 and parts of the buckles 4.

Figure 1:
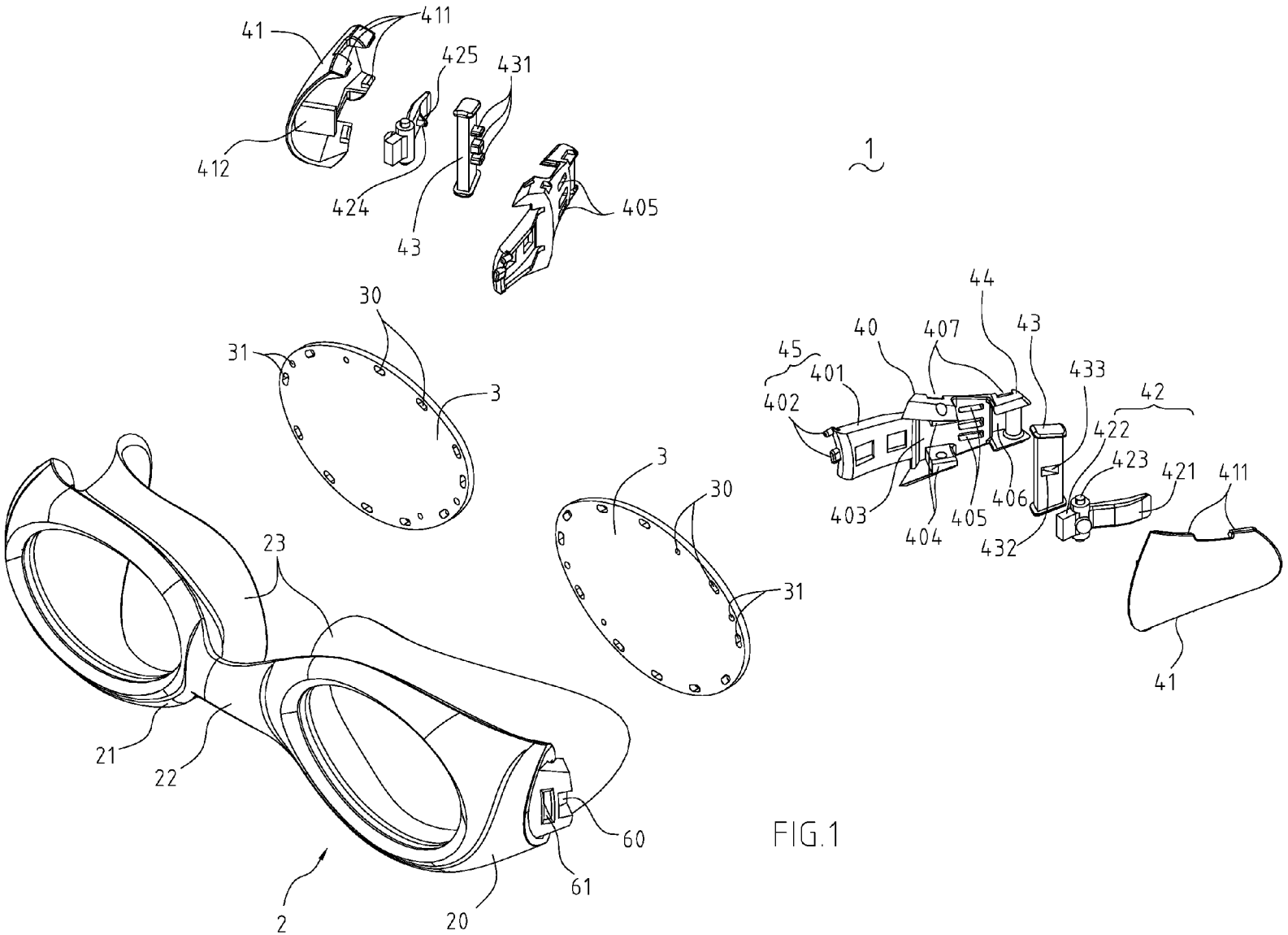
FIG. 1 is an exploded view of swimming goggles of the present invention.

Further referring to FIG. 1, each buckle 4 includes a base 40, a cover 41, an abutting arm 42, an operating lever 43 and an offset portion between the abutting arm 42 and the operating lever 43. The base 40 forms a link portion 45. In one embodiment, the link portion 45 comprises a branch 401 extending from an end of the base 40. A plurality of protuberances 402 is formed on a front end of the branch 401. A positioning portion is formed in the vicinity of the branch 401 of the base 40. In one embodiment, the positioning portion comprises an engraving portion 403 on the base 40. An axis support 404 is formed lengthwise along the engraving portion 403. Three rails 405 are transversely disposed neighboring the engraving portion 403. A guiding portion 44 is formed on an end of the base 40 and corresponds to the link portion 45 for guiding and positioning the head strap 50. In one embodiment, the guiding portion 44 includes a guiding bore 406 next to the rails 405 for guiding and positioning the head strap 50. Assembling portions are respectively formed on both sides of the base 40 and adjacent the axis support 404 and the guiding bore 406. In one embodiment, the assembling portions include embedding grooves 407 respectively in both sides of the base 40 for assembling with the cover 41.

The cover 41 comprises latch portions and locking portions. In one embodiment, the latch portions comprise latch posts 411 depending from the cover 41 and corresponding to the embedding grooves 407. The locking portions comprise engaging posts 412 on the cover 41 for assembling to the left frame 20 and the right frame 21.

The abutting arm 42 is pivoted to the axis support 404, and includes a stop end 421, an abutting end 422, and a pivot shaft 423 between the stop end 421 and the abutting end 422. The pivot shaft 423 is assembled onto the axis support 404 when assembled. As a result, the abutting arm 42 is pivoted to the axis support 404 complying with leverage principle. That is, the pivot shaft 423 acting as a fulcrum, the stop end 421 and the abutting end 422 move in reverse directions, respectively. The stop end 421 forms a stop block 424 thereon. A second inclined surface 425 is formed with an angle of 45 degree on the stop block 424.

The operating lever 43 is disposed below the abutting arm 42, and includes guiding bars 431 respectively corresponding to the rails 405. The guiding bars 431 fit to the rails 405 in width. Consequently, the guiding bars 431 are limited onto and transversely slide along the rails 405 reliably. The offset portion comprises a recessed portion 432 defined about a center of the operating lever 43. The recessed portion 432 forms a first inclined surface 433 with an angle of 45 degree for corresponding to the second inclined surface 425. The first inclined surface 433 and the second inclined surface 425 cooperate to each other with the angles of 45 degree, increasing sensitivity of movement of the stop end 421. Transverse movement of the operating lever 43 (referring to FIG. 4) brings the second inclined surface 425 of the abutting arm 42 to slide along the first inclined surface 433. Correspondingly, the stop end 421 moves upwardly, releasing the stop grooves 51 of the head strap 50. The operating lever 43 gradually increases in width toward both ends thereof for facilitating manual operation.

It is notable that resilient members 60 are provided on outward sides of the left frame 20 and the right frame 21. In one embodiment, the resilient members 60 is recessed and integrally formed on the left frame 20 and the right frame 21. Due to flexibility thereof, the resilient members 60 are capable of preserving energy when being pressed to deform. When the stop ends 421 move upwardly, the abutting ends 422 move downwardly and press against the resilient members 60 to make the resilient members 60 deform. When the operating levers 43 return to the original positions, preserved energy of the resilient members 60 drive the stop ends 421 to move to a state of stopping the head strap 50. Furthermore, locking grooves 61 are defined at outward sides of the left frame 20 and the right frame 21 for locking with the engaging posts 412 of the covers 41, whereby the buckles 4 are secured to the outward sides of the left frame 20 and the right frame 21.

A plurality of injecting holes 30 and assembling holes 31 are defined in peripherals of the lenses 3. Plastic is shaped to clamp and envelope peripherals of the lenses 3 through the injecting holes 30. In assembly, the protuberances 402 of the branches 401 are assembled onto the assembling holes 31 for preliminarily positioning. Therefore, the branches 401, the assembling holes 31 and the protuberances 402 are shrouded together during integrally shaping.

Referring to FIG. 1 and FIGS. 3-6, during assembly, the protuberances 402 of the branches 401 are preliminarily assembled to the assembling holes 31 of the lenses 3. The left frame 20, the right frame 21, the connecting portion 22 and the pad 23 are integrally shaped. At the same time, peripherals of the lenses 3 and the injecting holes 30, the branches 401, the assembling holes 31 and the protuberances 402 are enveloped. Thus the bases 40 of the buckles 4 are connected with the left frame 20, the right frame 21, the connecting portion 22 and the lenses 3. The guiding bars 431 of the operating levers 43 are assembled onto the rails 405. The pivot shafts 423 of the abutting arms 42 are mounted to the axis supports 404. The latch posts 411 of the covers 41 latch with the embedding grooves 407 of the bases 40. The engaging posts 412 of the covers 41 lock with the locking grooves 61. The operating levers 43 and the abutting arms 42 are assembled to the bases 40.

Figure 4:
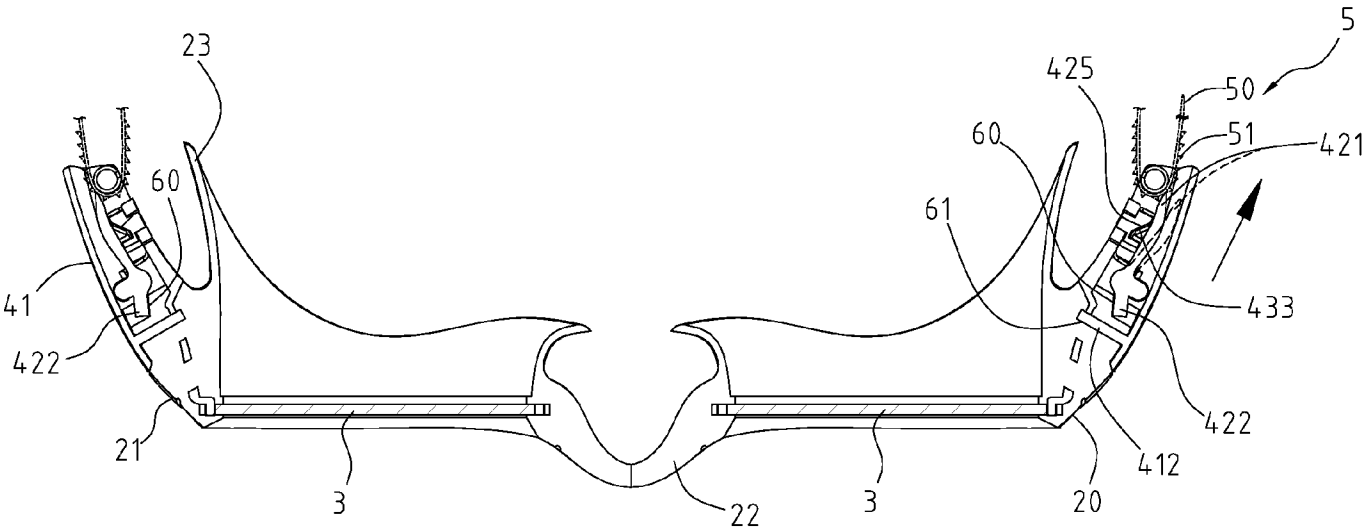
FIG. 4 is a sectional view taken along the line 4-4 in FIG. 3.
Figure 3:
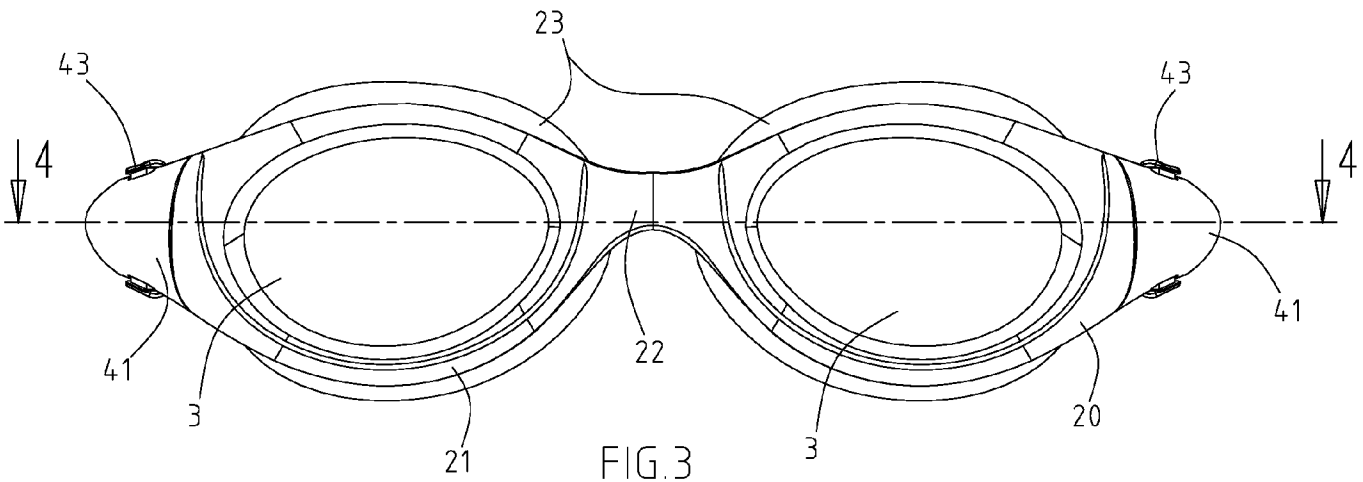
FIG. 3 is an elevation view of a frame unit of the swimming goggles of FIG. 1.
Figure 6:
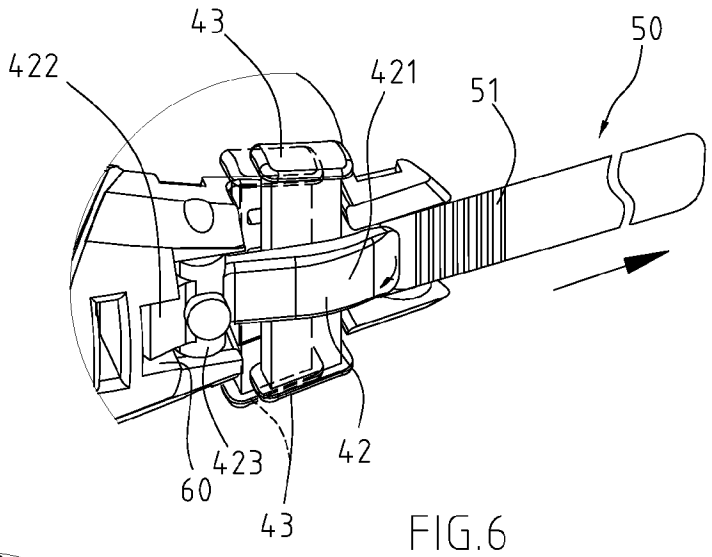
FIG. 6 is a partially enlarged view of the swimming goggles with a head strap assembled thereto.
Figure 5:
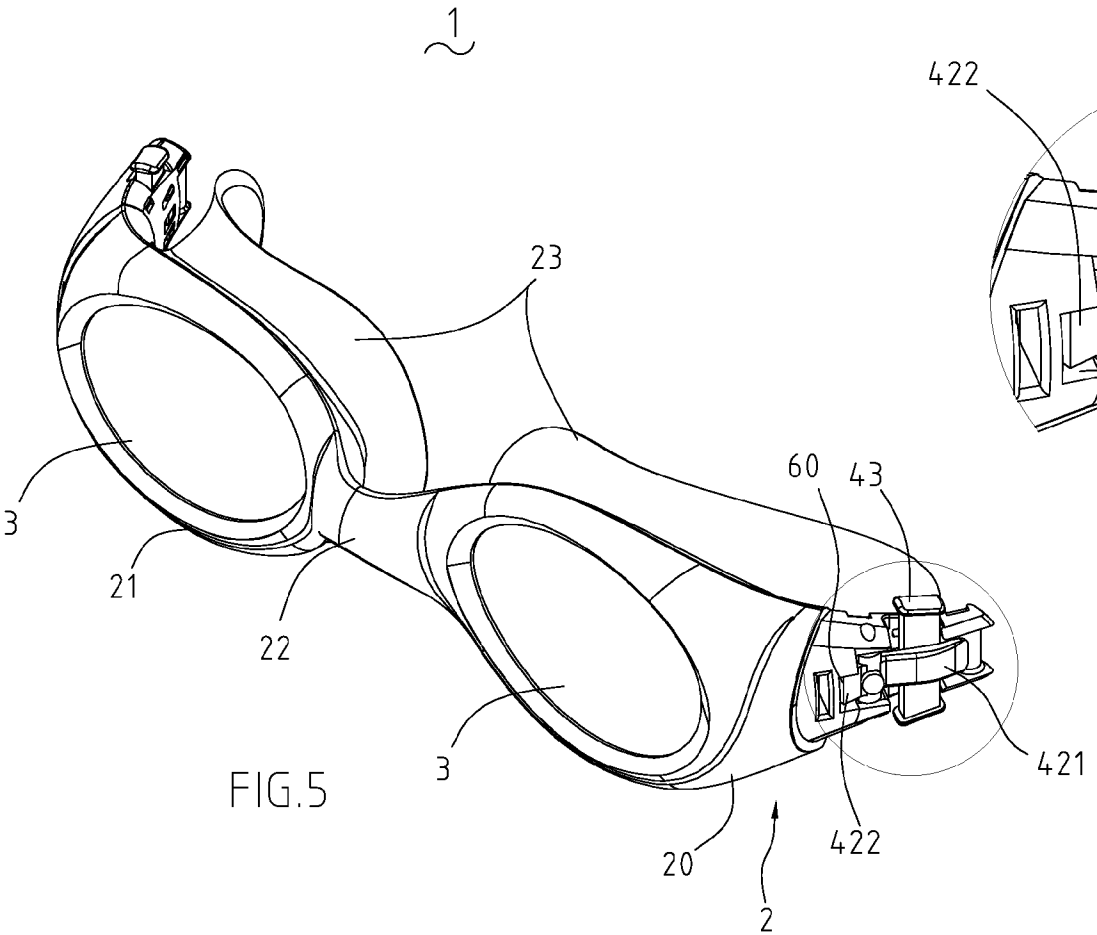
FIG. 5 is a perspective view of the swimming goggles, where a cover is removed.

When assembled, as shown in FIGS. 4 and 6, the stop ends 421 of the abutting arms 42 abut against the stop grooves 51 of the head strap 50. Meanwhile the head strap 50 is allowed to move only in a single direction as the arrow in FIG. 4. The head strap 50 is only permitted to be tightened and is prohibited to be loosened. When the operating levers 43 move transversely, as the dashed lines in FIGS. 4 and 6, the stop ends 421 move upwardly, and disengage from the stop grooves 51. The head strap 50 is allowed to move in the direction toward loosening. As the stop ends 421 move upward, the abutting ends 422 move downward and press the resilient members 60. The resilient members 60 are urged to deform to preserve energy. When the operating levers 43 move transversely to original positions, due to the preserved energy of the resilient members 60, the stop ends 421 return to abut the stop grooves 51. In this way, the head strap 50 is adjusted conveniently.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising a frame unit, lenses and buckles assembled on the frame unit, and a strap element with at least a head strap, the head strap defining a plurality of stop grooves, the buckles being capable of abutting or releasing the stop grooves of the head strap, each buckle comprising:

an abutting arm having a stop end and a pivot shaft, the stop end forming a stop block;

an operating lever being movable transversely and driving the abutting arm to move, and including at least a guiding bar;

a base including an engraving portion, an axis support, and at least a rail, the axis support being formed lengthwise along a part of the engraving portion and assembled with the pivot shaft, the at least a rail being transversely disposed on the engraving portion and neighboring the axis support; and a cover assembled to the base, the abutting arm and the operating lever being covered by the cover and the base, respectively;

wherein a recessed portion is defined at a center of the operating lever, the recessed portion forming a first inclined surface, the stop block forming a second inclined surface for corresponding to the first inclined surface, the first and second inclined surfaces respectively tilting at a same angle and being attachable to each other, and when the operating lever moves transversely, the second inclined surface of the abutting arm moves along the first inclined surface to bring the stop end to move upward or downward to abut or release the stop grooves of the head strap.

2. The swimming goggles as claimed in claim 1, wherein the guiding bar is limited by and transversely slidable along the rail.

3. The swimming goggles as claimed in claim 1, wherein the base further comprises a guiding portion for guiding and positioning the head strap.

4. The swimming goggles as claimed in claim 3, wherein the guiding portion comprises a guiding bore next to the rail.

5. The swimming goggles as claimed in claim 3, wherein the base forms a link portion corresponding to the guiding portion for assembling to the frame unit.

6. The swimming goggles as claimed in claim 5, wherein the link portion comprises a branch extending from an end of the base, a plurality of protuberances being formed on a front end of the branch.

7. The swimming goggles as claimed in claim 6, wherein a plurality of injecting holes and assembling holes are defined in peripheral parts of the lenses, the protuberances of the branches being assembled onto the assembling holes in assembly.

8. The swimming goggles as claimed in claim 7, wherein the frame unit is unitarily formed with soft material, and comprises a left frame, a right frame, a connecting portion and a pad, the frame unit further covering the peripheral parts of the lenses and the link portions of the bases.

9. The swimming goggles as claimed in claim 8, wherein the abutting arm further comprises an abutting end opposite to the stop end, the stop end and the abutting end moving in reverse directions when the operating lever transversely moves.

10. The swimming goggles as claimed in claim 9, further comprising resilient members, and the resilient members of providing return force for the abutting ends of the abutting arms when the abutting ends move downwardly to press the resilient members.

11. The swimming goggles as claimed in claim 8, wherein engaging posts are formed on the covers, and locking grooves are defined at portions of the left frame and the right frame for locking with the engaging posts, whereby the buckles are secured to the left frame and the right frame.

12. The swimming goggles as claimed in claim 1, wherein embedding grooves are respectively formed in both sides of the base, and latch posts are formed on the cover and correspond to the embedding grooves.

* * * * *